US010093500B2

(12) United States Patent
Tan et al.

(10) Patent No.: US 10,093,500 B2
(45) Date of Patent: Oct. 9, 2018

(54) CORRECTION DEVICE AND AUTOMATED TELLER MACHINE

(71) Applicant: GRG BANKING EQUIPMENT CO., LTD., Guangzhou, Guangdong (CN)

(72) Inventors: Dong Tan, Guangdong (CN); Guozhong Cao, Guangdong (CN); Hongjun Wu, Guangdong (CN); Zhongwu Lai, Guangdong (CN)

(73) Assignee: GRG BANKING EQUIPMENT CO., LTD., Guangzhou, Guangdong (CN)

( * ) Notice: Subject to any disclaimer, the term of this patent is extended or adjusted under 35 U.S.C. 154(b) by 0 days.

(21) Appl. No.: 15/510,530

(22) PCT Filed: Jul. 27, 2015

(86) PCT No.: PCT/CN2015/085184
§ 371 (c)(1),
(2) Date: Mar. 10, 2017

(87) PCT Pub. No.: WO2016/041414
PCT Pub. Date: Mar. 24, 2016

(65) Prior Publication Data

US 2017/0260016 A1 Sep. 14, 2017

(30) Foreign Application Priority Data

Sep. 17, 2014 (CN) ..... 2014 1 0476293

(51) Int. Cl.
*B65H 9/16* (2006.01)
*G07D 11/00* (2006.01)
*G07F 19/00* (2006.01)

(52) U.S. Cl.
CPC ..... *B65H 9/16* (2013.01); *B65H 9/166* (2013.01); *G07D 11/0027* (2013.01);
(Continued)

(58) Field of Classification Search
CPC ..... B65H 9/16; B65H 9/163; B65H 9/166; B65H 2301/331; B65H 2301/4423;
(Continued)

(56) References Cited

U.S. PATENT DOCUMENTS 5,048,817 A * 9/1991 Roller ..... B65H 9/166 271/250
5,564,544 A 10/1996 Takemoto et al.
(Continued)

FOREIGN PATENT DOCUMENTS

CN 1990367 A 7/2007
CN 201122303 Y 9/2008
(Continued)

OTHER PUBLICATIONS

International Search Report for PCT/CN2015/085184, dated Nov. 6, 2015, ISA/CN.

*Primary Examiner* — Jeremy R Severson
(74) *Attorney, Agent, or Firm* — U.S. Fairsky LLP; Yue (Robert) Xu

(57) ABSTRACT

A deflection correcting device includes a banknote running passage defined by a first passage plate and a second passage plate. Deflection correcting wheels are arranged in the banknote running passage and a deflection correcting direction of the deflection correcting wheels is deflected from a reference side of the banknote running passage. A lateral guiding mechanism is provided at the reference side, and configured to drive a banknote that reaches the reference side to move in the transmission direction of the banknote running passage; and a deflection correcting adjusting wheel is provided at a tail end in a deflection direction of the plurality of the deflection correcting wheels, and a deflection correcting direction of the deflection correcting adjusting wheel is deflected from the reference side. The banknote is
(Continued)

prevented from jamming at the reference side and the passage.

13 Claims, 7 Drawing Sheets

(52) U.S. Cl.
CPC ..... *G07F 19/20* (2013.01); *B65H 2301/331* (2013.01); *B65H 2301/4422* (2013.01); *B65H 2301/4475* (2013.01); *B65H 2404/267* (2013.01); *B65H 2701/1912* (2013.01)

(58) Field of Classification Search
CPC ..... B65H 2301/4475; B65H 2404/267; B65H 2301/4422; G07D 11/0027
See application file for complete search history.

(56) References Cited

U.S. PATENT DOCUMENTS

| | | | | |
|---|---|---|---|---|
| 8,113,511 | B2 * | 2/2012 | Kallin | B65H 9/166 271/228 |
| 8,469,358 | B1 * | 6/2013 | Wen | B65H 5/062 271/250 |
| 8,789,828 | B2 * | 7/2014 | Wang | G07D 11/0027 271/251 |
| 8,915,497 | B2 * | 12/2014 | Machamer | B65H 9/166 271/248 |
| 9,540,199 | B2 * | 1/2017 | Wang | G07F 19/202 |
| 2011/0042887 | A1 * | 2/2011 | Kallin | B65H 9/166 271/227 |
| 2014/0083815 | A1 | 3/2014 | Chang et al. | |
| 2014/0183816 | A1 | 7/2014 | Wang et al. | |
| 2016/0055700 | A1 | 2/2016 | Wang et al. | |

FOREIGN PATENT DOCUMENTS

| | | | |
|---|---|---|---|
| CN | 102324154 | A | 1/2012 |
| CN | 103236120 | A | 8/2013 |
| CN | 103679913 | A | 3/2014 |
| CN | 104200581 | A | 12/2014 |
| JP | H0930687 | A | 2/1997 |
| JP | 3927290 | B2 | 6/2007 |
| KR | 20140084742 | A | 7/2014 |
| WO | 2012110556 | A1 | 8/2012 |

* cited by examiner

CORRECTION DEVICE AND AUTOMATED TELLER MACHINE

This application is the national phase of International Application No. PCT/CN2015/085184, titled "CORRECTION DEVICE AND AUTOMATED TELLER MACHINE", filed on Jul. 27, 2015 which claims the benefit of priority to Chinese patent application No. 201410476293.0 titled "CORRECTION DEVICE AND AUTOMATED TELLER MACHINE", filed with the Chinese State Intellectual Property Office on Sep. 17, 2014, the entire disclosures of which applications are incorporated herein by reference.

FIELD

The present application relates to the technical field of automatic teller machines, and in particular to a deflection correcting device and an automatic teller machine.

BACKGROUND

In the process of depositing banknotes into an ATM (Automated Teller Machine), the banknotes are apt to deflect when being put into a banknote depositing port of the ATM by a customer. When the deflected banknotes enter a banknote depositing core or a banknote box of the ATM, errors such as being unidentifiable or a jamming may occur and thus a normal operation of the machine is adversely affected. Therefore, the entered banknotes are required to be performed with the deflection correcting.

In a conventional deflection correcting device, multiple deflection correcting wheels are provided in a banknote running passage, and these deflection correcting wheels move banknotes in the banknote running passage towards one side (a reference wall) of the passage. When the banknotes hit the reference wall, because of an interception action from the reference wall to the banknotes and a forward transmission action from a transmission wheel in the passage, a deflection correction to the banknotes are realized when the banknotes leave the passage.

However, when the banknotes hit the reference wall and the reference wall intercepts the banknotes, if the banknotes are required to fit with the reference wall and keep moving, the banknotes should have sufficient rigidity. In a case that the banknotes are old banknotes, a phenomenon that the banknotes are jammed in the reference walls and the passage during the deflection correcting process, is apt to occur.

SUMMARY

A deflection correcting device and an automatic teller machine are provided according to the embodiments of the present application, which can realize a deflection correcting for banknotes and prevent the banknotes from jamming at a reference wall and a passage during a process of deflection correcting.

The deflection correcting device according to the embodiments of the present application includes a banknote running passage defined by a first passage plate and a second passage plate, deflection correcting wheels are arranged in the banknote running passage and a deflection correcting direction of the deflection correcting wheels is deflected from a reference side of the banknote running passage, a plurality of the deflection correcting wheels are dispersedly arranged in a transmission direction of the banknote running passage and are gradually close to the reference side, wherein a lateral guiding mechanism is provided at the reference side, and configured to drive a banknote that reaches the reference side to move in the transmission direction of the banknote running passage; and a deflection correcting adjusting wheel is provided at a tail end in a deflection direction of the plurality of the deflection correcting wheels and is close to the reference side, and a deflection correcting direction of the deflection correcting adjusting wheel is deflected from the reference side.

Optionally, the lateral guiding mechanism includes a power shaft, two conical wheels and a turning belt; the turning belt is installed between the two conical wheels; the power shaft fixedly passes through one of the two conical wheels and is configured to drive the conical wheel to rotate; and the turning belt is arranged on the reference side and has a running direction coincident with the transmission direction.

Optionally, the lateral guiding mechanism further includes a plurality of pinch rollers and a plurality of tensioning wheels;

the pinch roller are in a press fit with the conical wheels respectively; and the tensioning wheels are installed at inner sides of the turning belt and is configured to assist the turning belt to transmit Optionally, a surface moving speed of the turning belt is coincident with a speed of the banknote moving forward.

Optionally, the lateral guiding mechanism includes a turntable transmission shaft and a guiding turntable; the turntable transmission shaft fixedly passes through the guiding turntable and is configured to drive the guiding turntable to rotate; and a surface of the guiding turntable is arranged on the reference side and a running direction of the surface of the guiding turntable is coincident with the transmission direction.

Optionally, the lateral guiding mechanism includes a driving wheel, a plurality of driven wheels and a synchronous belt; the synchronous belt is installed on the driving wheel and the plurality of driven wheels; the driving wheel is configured to drive the synchronous belt and the plurality of driven wheels; and a lateral side of the synchronous belt is arranged on the reference side and a running direction of the synchronous belt is coincident with the transmission direction.

Optionally, the deflection correcting adjusting wheel is a polygonal adjusting wheel.

Optionally, a linear velocity of a maximum diameter of the deflection correcting adjusting wheel is coincident with a linear velocity of the deflection correcting wheels.

Optionally, the deflection correcting wheels are arranged in a middle portion of the banknote running passage and include three rows of deflection correcting wheels, and deflection correcting directions of the three rows of deflection correcting wheels are the same;

the three rows of deflection correcting wheels are respectively a first row of deflection correcting wheel, a second row of deflection correcting wheel and a third row of deflection correcting wheel in the transmission direction, deflection correcting floating wheels are arranged on the banknote running passage and in a press fit with the deflection correcting wheels respectively;

pressures applied on the three rows of deflection correcting wheels by the deflection correcting floating wheels are a first row pressure, a second row pressure and a third row pressure respectively; and the second row pressure is larger than the third row pressure, and the third row pressure is larger than the first row pressure.

Optionally, an automatic banknote depositing device is provided with the above-mentioned deflection correcting device.

According to the above technical solutions, the embodiments of the present application have the following advantages.

In the embodiments of the present application, a deflection correcting device includes a banknote running passage defined by a first passage plate and a second passage plate, deflection correcting wheels are arranged in the banknote running passage and a deflection correcting direction of the deflection correcting wheels is deflected from a reference side of the banknote running passage, a plurality of the deflection correcting wheels are dispersedly arranged in a transmission direction of the banknote running passage and are gradually close to the reference side, a lateral guiding mechanism is provided at the reference side, and configured to drive a banknote that reaches the reference side to move in the transmission direction of the banknote running passage; and a deflection correcting adjusting wheel is provided at a tail end in a deflection direction of the plurality of the deflection correcting wheels and is close to the reference side, and a deflection correcting direction of the deflection correcting adjusting wheel is deflected from the reference side.

In the embodiments of the present application, the banknote first gradually gets close to the reference side under the action of the deflection correcting wheels, and after the banknote reaches the reference side, the banknote is driven to move forward by the lateral guiding mechanism and in this case a phenomenon that the head portion of the banknote deflects from the reference side may occur. In a case that the head portion of the banknote deflects, the head portion of the banknote is adjusted to be close to the reference side again by the deflection correcting adjusting wheel arranged at the tail end, and the banknote is re-adjusted and a deflection correction is realized, therefore even the rigidity of the banknote is insufficient, the banknote can be driven by the lateral guiding mechanism to fit with the reference side and thus is prevented from jamming at the reference side and the passage during the deflection correcting process.

BRIEF DESCRIPTION OF THE DRAWINGS

For more clearly illustrating embodiments of the present application or the technical solution in the prior art, drawings are briefly introduced below to describe the embodiments or the prior art. Apparently, the drawings are used to illustrate some embodiments of the present application, and those skilled in the art may achieve other drawings, based on these drawings, without any creative efforts.

DETAILED DESCRIPTION

A deflection correcting device and an automatic teller machine are provided according to the embodiments of the present application, and are configured to realize a deflection correcting of banknotes and prevent the banknotes from jamming in reference walls and a passage during a process of deflection correcting.

For the purposes, features and advantages of the present application to be obvious and better understood, the technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the scope of the present application.

Reference is made to FIGS. 1 to 8, a deflection correcting device according to the embodiments of the present application is provided.

Figure 1:
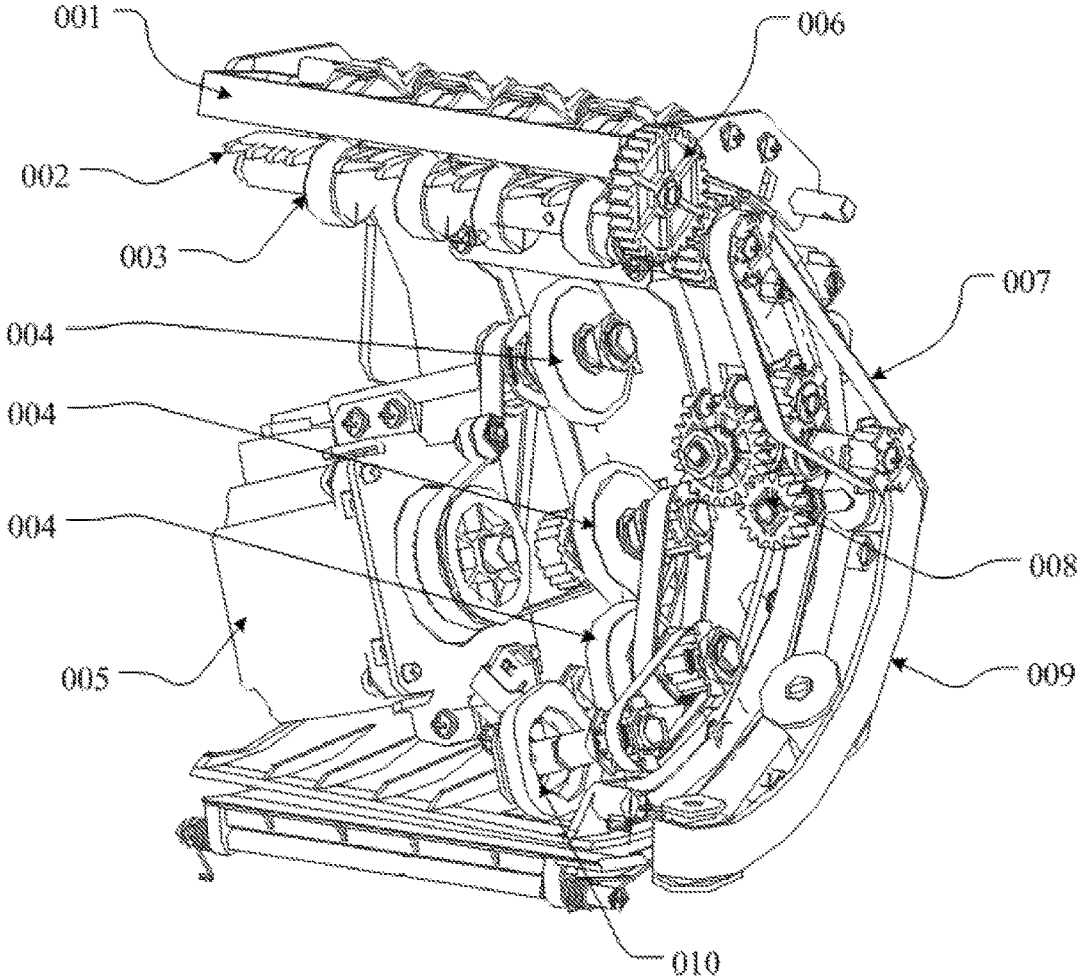
FIG. 1 is a schematic view showing the three-dimensional structure of a deflection correcting device according to an embodiment of the present application.
Figure 2:
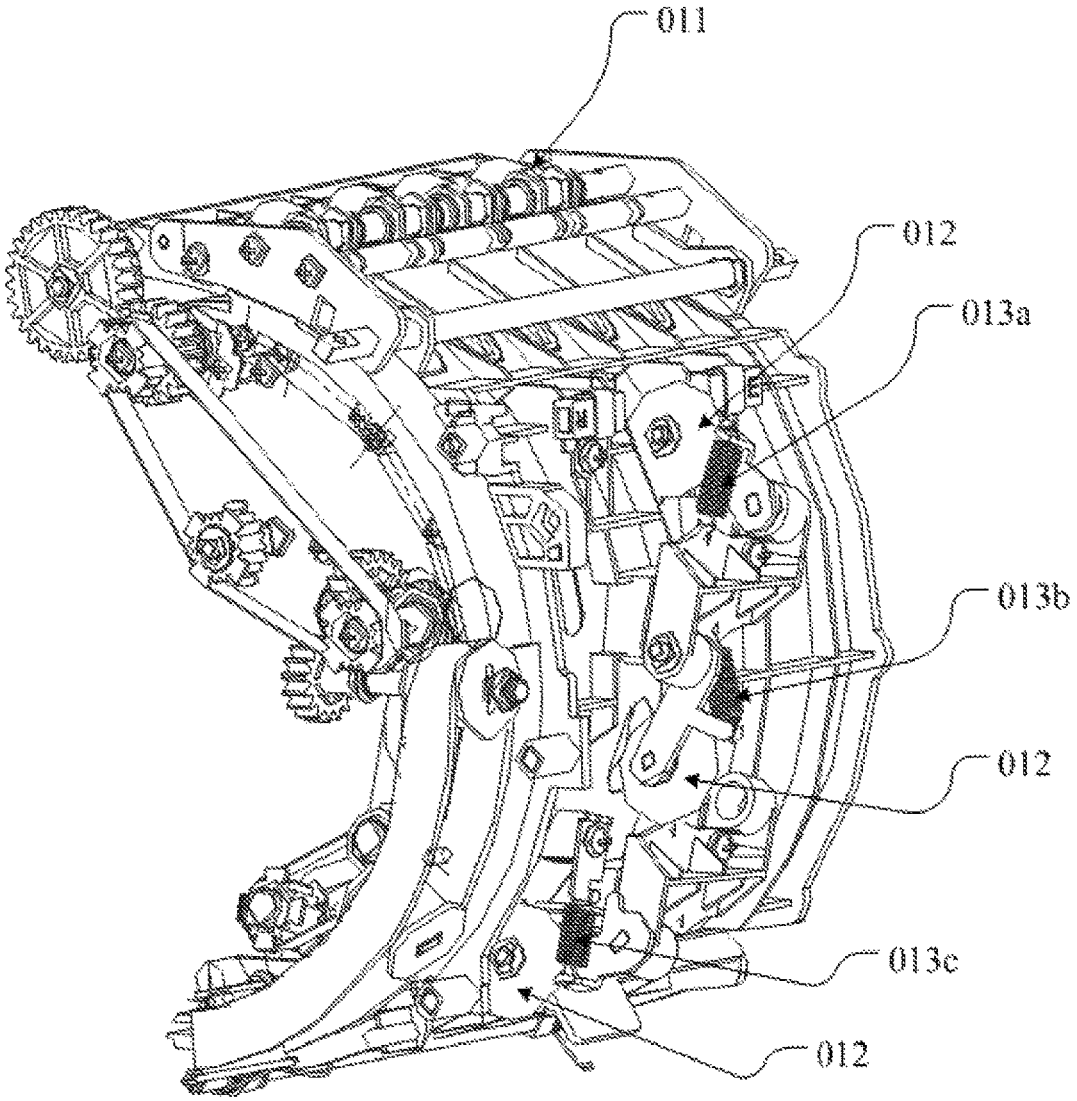
FIG. 2 is a schematic view showing the structure of the deflection correcting device in FIG. 1 viewed from another angle.

FIGS. 1 and 2 are schematic views showing a three-dimensional structure of the deflection correcting device according to an embodiment of the present application, and the deflection correcting device includes a first passage plate 001, a second passage plate 002, a transmission shaft 003, deflection correcting wheels 004, an electric motor 005, a first gear 006, a driving belt 007, a second gear 008, a lateral guiding mechanism 009, a deflection correcting adjusting wheel 010, a transmission shaft floating wheel 011, a deflection correcting floating wheel 012 and a deflection correcting wheel pressure spring 013.

Figure 8:
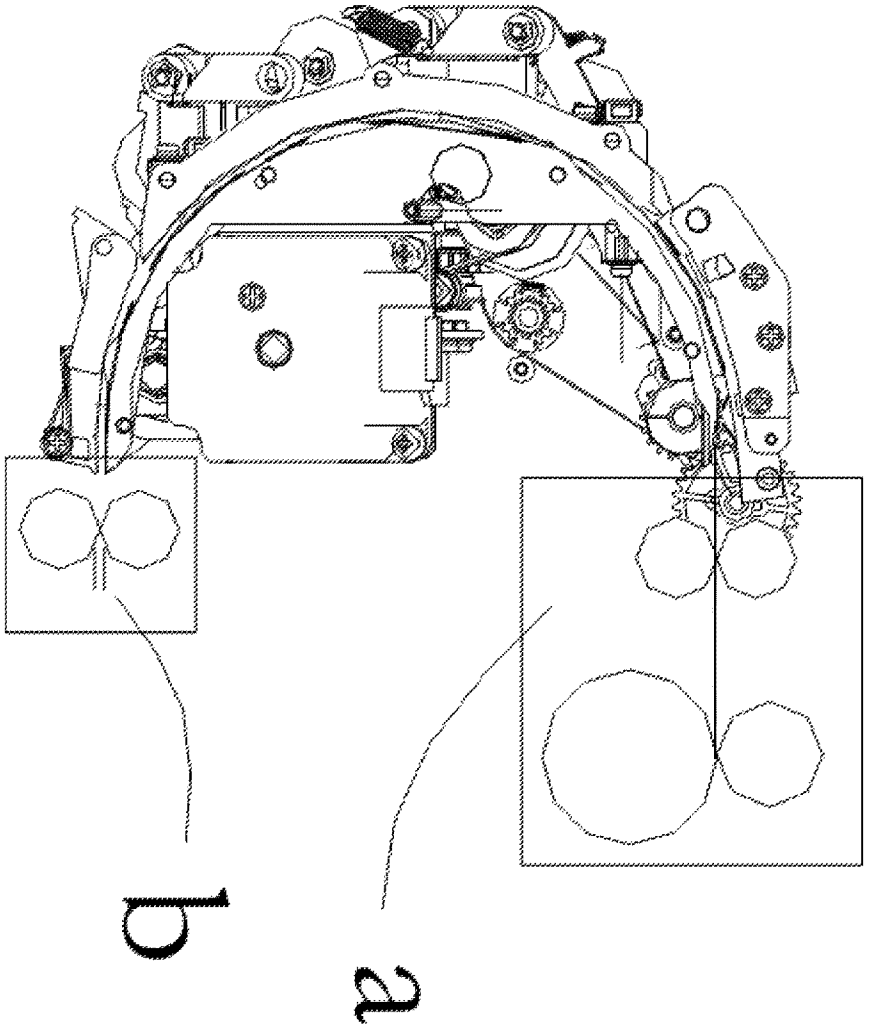
FIG. 8 is a schematic view showing the positions of areas a and b in the embodiments of the present application.

As shown in FIG. 8, an area a mentioned hereinafter refers to a banknote separation mechanism arranged in front of the deflection correcting device, and an area b refers to a banknote conveying mechanism arranged at a tail end of the deflection correcting device.

Figure 3:
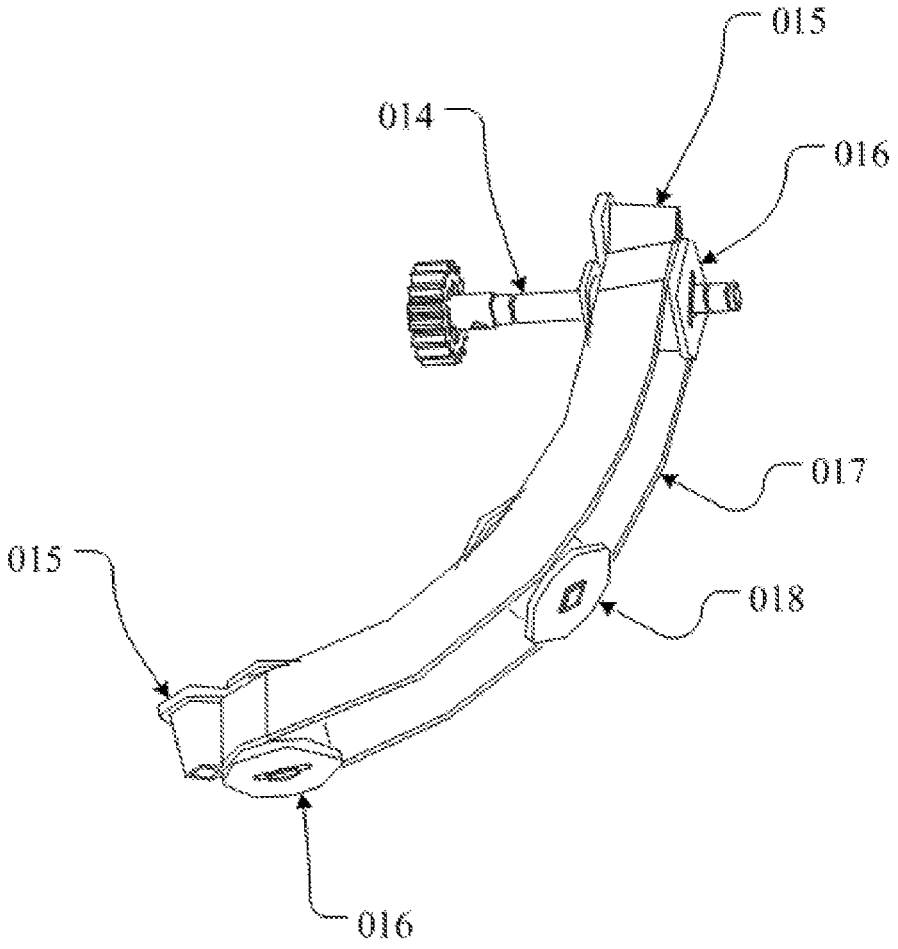
FIG. 3 is a schematic view showing the structure of a turning belt guiding mechanism.

FIG. 3 shows one structure of the lateral guiding mechanism 009, i.e., a turning belt guiding mechanism which includes a power shaft 014, a pinch roller 015, a conical wheel 016, a turning belt 017 and a tensioning wheel 018.

Figure 4:
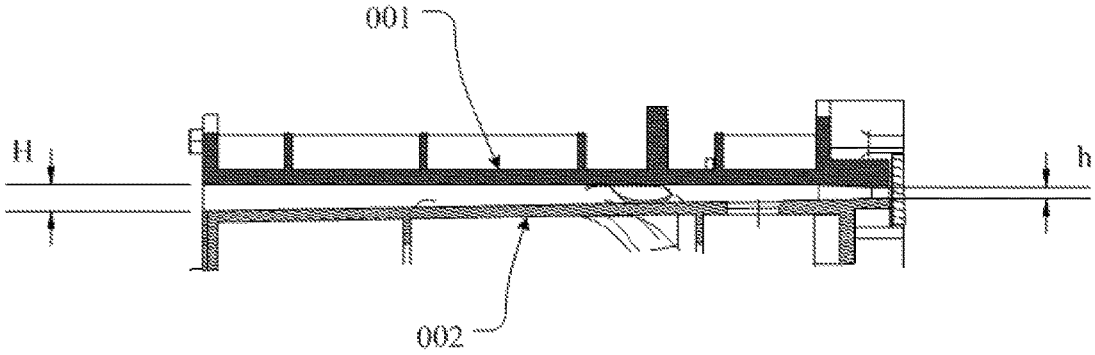
FIG. 4 is a sectional view of a banknote running passage.

FIG. 4 is a sectional view of a banknote running passage, in which H represents a wide distance of the passage and h represents a narrow distance of the passage.

Figure 5:
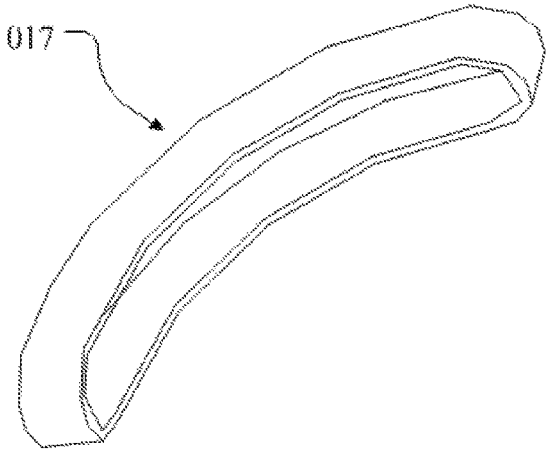
FIG. 5 is schematic view showing the structure of a turning belt.

FIG. 5 is a schematic view showing the structure of the turning belt.

Figure 6:
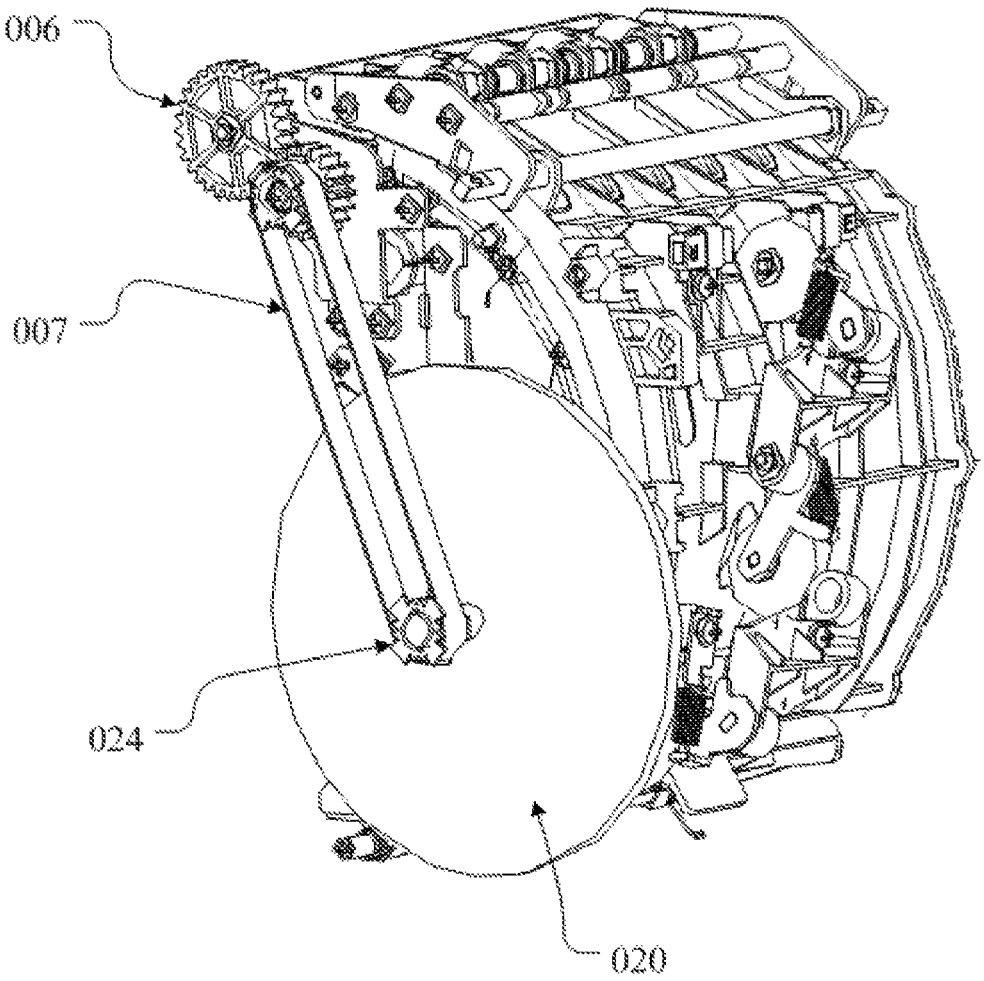
FIG. 6 is a schematic view showing the structure of the deflection correcting device according to another embodiment of the present application.

FIG. 6 shows one structure of the lateral guiding mechanism 009, i.e., a guiding turntable mechanism which includes a guiding turntable 020 and a turntable transmission shaft 024.

Figure 7:
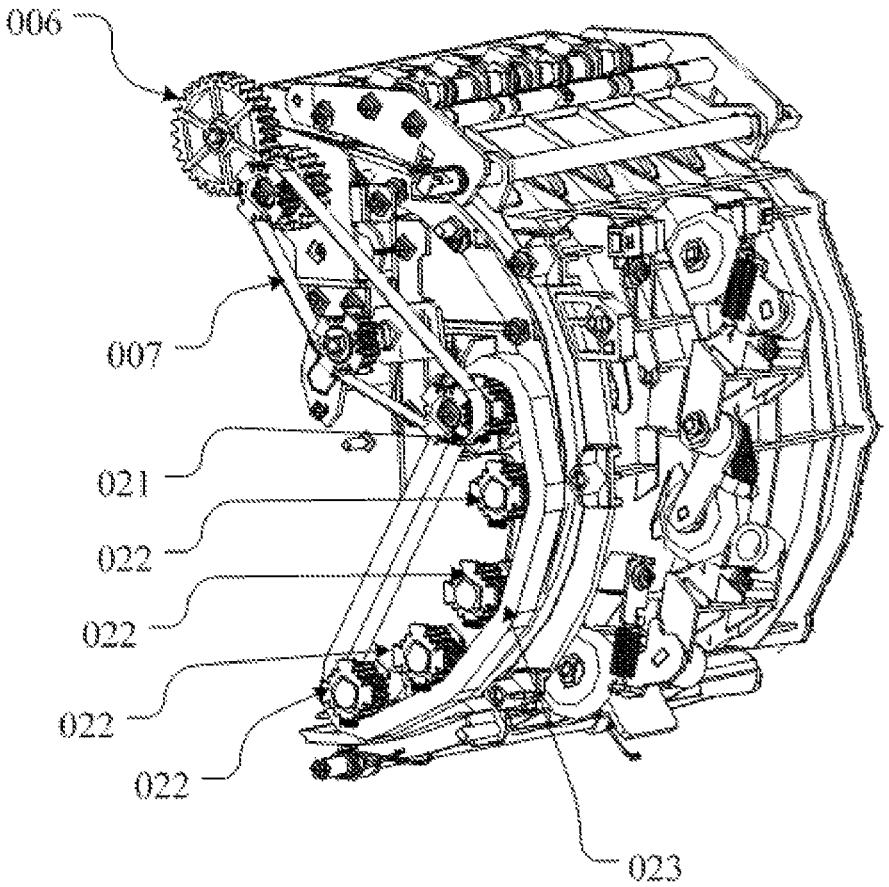
FIG. 7 is a schematic view showing the structure of the deflection correcting device according to another embodiment of the present application.

FIG. 7 shows one structure of the lateral guiding mechanism 009, i.e., a guiding synchronous belt mechanism which includes a driving wheel 021, a driven wheel 022 and a synchronous belt 023.

In a case that the lateral guiding mechanism 009 is embodied as the turning belt guiding mechanism, the structure of the deflection correcting device is described as follows.

Generally, a banknote running passage, which allows the banknotes to pass, is formed by the first passage plate 001 and the second passage plate 002. The banknote running passage is a passage having a cross section with a variable width along a banknote running direction. As shown in FIG. 4, h is a passage side close to one side (a reference side) of the lateral guiding mechanism, and H is a passage side away from the reference side, wherein H>h>0.8 mm.

Generally, a plurality of transmission wheels with a large frictional coefficient (for example rubber) are provided on the transmission shaft 003, each transmission shaft floating wheel 011 is in a press fit with each transmission wheel on the transmission shaft 003 and is in a one-to-one correspondence with the transmission wheel. A spring or other elastic part acts on the transmission shaft floating wheel 011, thus an object of clamping and conveying the banknotes can be realized, and power of the transmission wheel is transferred from the area a by the first gear 006.

As shown in FIG. 1, the deflection correcting device is provided with several groups of the deflection correcting wheels 004, which are driven by the electric motor 005. For example, there are three groups of the deflection correcting wheels 004 in this embodiment. Each group of the deflection correcting wheels 004 extends into the banknote running passage defined by the first passage plate 001 and the second passage plate 002, a top surface of each deflection correcting wheel 004 is pressed by the deflection correcting floating wheel 012, and the deflection correcting floating wheel 012 is under the action of a deflection correcting wheel pressure spring 013 and forms different pressures. As shown in FIGS. 2, 013*a*, 013*b* and 013*c* respectively represent deflection correcting wheel pressure springs 013 on three groups of the deflection correcting floating wheel 012 arranged along a conveying direction of the banknotes running passage. Pressures Fa, Fb and Fc on the deflection correcting floating wheel 012, exerted by the deflection correcting wheel pressure springs 013*a*, 013*b* and 013*c* respectively, should meet the following condition: Fb>Fc>Fa. The arrangement direction of the three deflection correcting wheel pressure springs 013 and the banknotes running direction (conveying direction) form a certain angle.

As shown in the FIGS. 1, 2 and 3, one end of the turning belt guiding mechanism 009, which end is close to an end of the passage with a distance of h, functions as a reference side of banknotes deflection correcting. A moving direction of the turning belt, which functions as the reference side, should be coincident with the banknote running direction and should have a surface moving speed which is coincident with a speed of the banknote moving forward. The turning belt 017 may circularly rotate under the action of the conical wheel 016 driven by the power shaft 014, and power of the power shaft 014 is transferred by the first gear 006, the driving belt 007 and the second gear 008 from the area a (the banknote separating mechanism in front of the deflection correct device). For making the turning belt 017 to transmit smoothly, a certain number of pinch rollers 015 and tensioning wheels 018 may be provided in the transmission mechanism to assist transmission.

Preferably, the deflection correcting adjusting wheel 010 may be a pentagonal wheel, a gap of 0.1 mm should be provided between an outer diameter of the deflection correcting adjusting wheel 010 and the first passage plate 001, and an arrangement angle of the deflection correcting adjusting wheel 010 should be coincident with an arrangement angle of the deflection correcting wheel 004. The power of the deflection correcting adjusting wheel 010 is also provided by the electric motor 005 and has a maximum diameter, a linear velocity of the maximum diameter is coincident with a linear velocity of the deflection correcting wheel 004.

It should be noted that, the lateral guiding mechanism 009 is not limited to the turning belt guiding mechanism, and any mechanism that can rotate and generate a forward friction force to the banknotes is feasible, for example a turntable and a synchronous belt, and the lateral guiding mechanism 009 is not limited herein.

A working process of the deflection correcting device in this embodiment will be described hereafter in detail, and reference is made to FIGS. 1 and 2.

After being separated from the banknote separating mechanism at the area a, the banknote is clamped and conveyed forward by the transmission shaft 003. When the banknote reaches the first group of deflection correcting wheel 004, the deflection correcting wheel 004 generates a lateral force towards the reference side to the banknote. However, because a clamping force generated by the transmission shaft floating wheel 011 and the transmission shaft 003 is larger than a clamping force generated by the deflection correcting wheel 004 and the deflection correcting floating wheel 012, and the deflection correcting wheel 004 is close to the transmission shaft 003, the lateral force generated by first group of deflection correcting wheel 004 cannot drive the banknote toward the reference side yet.

When the banknote continue to move forward to reach the second group of deflection correcting wheel 004, a lateral force generated by the second group of deflection correcting wheel 004 is larger than the lateral force of the first group, and a large part of the banknote has been conveyed to a deflection correcting area (banknote running passage) at this time, if the banknote is a short banknote, the banknote may already completely leave the transmission shaft 003, at this moment, the banknote moves toward the reference side under the lateral force generated by the first and the second groups of deflection correcting wheels 004. When the banknote continues to move forward and reaches the third group of deflection correcting wheel 004, the banknote is subjected to a larger lateral force and is closer to the reference side. When the action of deflection correcting continues, one corner of the banknote firstly reaches the reference side firstly because the banknote gets close to the reference side obliquely. At this moment, since the turning belt 017 has been rotated already, a forward friction force is generated, by the turning belt 017, to the corner of the banknote that reaches the reference side, and thus the banknote is driven to move forward and is unlikely to be bent here to cause a jamming.

When the banknote continues moving forward and the action of deflection correcting goes on, a head portion of banknote has already been corrected in place. However, because it is possible that the action of deflection correcting is still performed on a tail portion of the banknote, and furthermore because of the action of the friction force of the passage, a phenomenon occurs that the head portion of the banknote generates a certain deflection relative to the reference side. For solving the phenomenon, a group of deflection correcting adjusting wheel 010 is required to be provided. The deflection correcting adjusting wheel 010 may be a pentagonal wheel, and a lateral force is intermittently generated during a rotating process, therefore the head portion of the banknote which deflects from the reference side is allowed to get close to the reference side again. When the banknote keeps moving forward, the head portion of the banknote may enter the area b and is clamped and conveyed forward by a driving wheel of a conveying mechanism. When the tail portion of the banknote leaves the deflection correcting adjusting wheel 010, the entire action of deflection correcting is finished.

It should be noted that in a case that the lateral guiding mechanism 009 is the guiding turntable or the guiding synchronous belt, the working process of the deflection correcting device is almost the same as that described above, and thus will not be described herein. The working principle of the guiding turntable and the guiding synchronous belt will be briefly described hereinafter.

As shown in FIG. 6, in the guiding turntable mechanism, a turntable transmission shaft 024 is rotated by the power transmitted by the first gear 006 and the driving belt 007, thus a guiding turntable 020 fixed on the turntable transmission shaft 024 is driven to rotate. It should be noted that, the turntable driving wheel and the guiding turntable 020 are required to be arranged reasonably, to allow a linear velocity of a surface of the guiding turntable 020, which surface is close to the reference side, is coincident with a velocity of the banknote moving forward, and a moving direction is coincident with a transmission direction after the guiding turntable 020 rotates.

As shown in FIG. 7, in the guiding synchronous belt mechanism, a driving wheel 021 is rotated by the power transmitted by the first gear 006 and the driving belt 007, thus a synchronous belt 023 fixed on the driving wheel 021 is driven to rotate, and the synchronous belt 023 further drives driven wheels 022 to rotate together. It should be noted that, the driving wheel 021, the driven wheel 022 and the synchronous belt 023 are required to be arranged reasonably, to allow a linear velocity of a surface of the synchronous belt 023, which surface is close to the reference side, is coincident with a velocity of the banknote moving forward, and a moving direction is coincident with a transmission direction after the synchronous belt 023 rotates.

In the embodiments of the present application, a deflection correcting device includes a banknote running passage defined by a first passage plate 001 and a second passage plate 002, and deflection correcting wheels 004 are arranged in the banknote running passage and a deflection correcting direction of the deflection correcting wheels 004 is deflected from a reference side of the banknote running passage. A plurality of the deflection correcting wheels 004 are dispersedly arranged in a transmission direction of the banknote running passage and are gradually close to the reference side. The reference side is provided with a lateral guiding mechanism 009 configured to drive the banknote that reaches the reference side to move in the transmission direction of the banknote running passage. A deflection correcting adjusting wheel 010 is provided at a tail end in a deflection direction of a plurality of the deflection correcting wheels 004 and is close to the reference side, and a deflection direction of the deflection correcting adjusting wheel 010 is deflected from the reference side. In the embodiments of the present application, the banknote first gradually gets close to the reference side under the action of the deflection correcting wheels 004, and after the banknote reaches the reference side, the banknote is driven to move forward by the lateral guiding mechanism 009 and in this case a phenomenon that the head portion of the banknote deflects from the reference side may occur. In a case that the head portion of the banknote deflects, the head portion of the banknote is adjusted to be close to the reference side again by the deflection correcting adjusting wheel 010 arranged at the tail end, and the banknote is re-adjusted and a deflection correction is realized, therefore even the rigidity of the banknote is insufficient, the banknote can be driven by the lateral guiding mechanism 009 to fit with the reference side and thus is prevented from jamming at the reference side and the passage during the deflection correcting process.

Based on the deflection correcting device according to the above embodiments, an automatic teller machine is further provided by the present application, which is provided with an automatic banknote depositing device and a deflection correcting device is provided in the automatic banknote depositing device, the deflection correcting device is the deflection correcting device according to the above embodiments.

Since the automatic teller machine adopts the deflection correcting device in the above embodiments, beneficial effects of the automatic teller machine brought by the deflection correcting device can be referred to the above embodiments.

It will be apparent to those skilled in the art that the specific operations of the systems, apparatuses and units described above may be referred to the corresponding processes described in the foregoing method embodiments for the sake of convenience and conciseness of the description and will not be described here.

The above embodiments are merely intended to illustrate and not limit the technical solution of the present application; even though the present application has been described in detail with reference to the foregoing embodiments, it will be understood by those skilled in the art that modifications to the technical solutions described in the foregoing embodiments or equivalent substitutions of a part of the technical features can still be made; the modifications and substitutions do not make the essence of the corresponding technical solutions to depart from the spirit and scope of the technical solutions of the embodiments of the present application.

What is claimed is:

1. A deflection correcting device, comprising a banknote running passage defined by a first passage plate and a second passage plate, wherein deflection correcting wheels are arranged in the banknote running passage and a deflection correcting direction of the deflection correcting wheels is deflected from a reference side of the banknote running passage, a plurality of the deflection correcting wheels are dispersedly arranged in a transmission direction of the banknote running passage and are gradually close to the reference side, wherein:

a lateral guiding mechanism is provided at the reference side, and configured to drive a banknote that reaches the reference side to move in the transmission direction of the banknote running passage; and a deflection correcting adjusting wheel is provided at a tail end in a deflection direction of the plurality of the deflection correcting wheels and is close to the reference side, and a deflection correcting direction of the deflection correcting adjusting wheel is deflected from the reference side; and wherein the lateral guiding mechanism comprises a power shaft, two conical wheels and a turning belt;

the turning belt is installed between the two conical wheels;

the power shaft fixedly passes through one of the two conical wheels and is configured to drive the conical wheel to rotate; and the turning belt is arranged on the reference side and has a running direction coincident with the transmission direction.

2. The deflection correcting device according to claim 1, wherein the lateral guiding mechanism further comprises a plurality of pinch rollers and a plurality of tensioning wheels;

the pinch roller are in a press fit with the conical wheels respectively; and the tensioning wheels are installed at inner sides of the turning belt and is configured to assist the turning belt to transmit.

3. An automatic teller machine, comprising an automatic banknote depositing device, wherein the deflection correcting device according to claim 2 is provided in the automatic banknote depositing device.

4. The deflection correcting device according to claim 1, wherein a surface moving speed of the turning belt is coincident with a speed of the banknote moving forward.

5. An automatic teller machine, comprising an automatic banknote depositing device, wherein the deflection correcting device according to claim 4 is provided in the automatic banknote depositing device.

6. The deflection correcting device according to claim 1, wherein the deflection correcting adjusting wheel is a polygonal adjusting wheel.

7. The deflection correcting device according to claim 6, wherein a linear velocity of a maximum diameter of the deflection correcting adjusting wheel is coincident with a linear velocity of the deflection correcting wheels.

8. An automatic teller machine, comprising an automatic banknote depositing device, wherein the deflection correcting device according to claim 7 is provided in the automatic banknote depositing device.

9. An automatic teller machine, comprising an automatic banknote depositing device, wherein the deflection correcting device according to claim 6 is provided in the automatic banknote depositing device.

10. The deflection correcting device according to claim 1, wherein the deflection correcting wheels are arranged in a middle portion of the banknote running passage and comprise three rows of deflection correcting wheels, and deflection correcting directions of the three rows of deflection correcting wheels are the same;

the three rows of deflection correcting wheels are respectively a first row of deflection correcting wheel, a second row of deflection correcting wheel and a third row of deflection correcting wheel in the transmission direction, deflection correcting floating wheels are arranged on the banknote running passage and in a press fit with the deflection correcting wheels respectively;

pressures applied on the three rows of deflection correcting wheels by the deflection correcting floating wheels are a first row pressure, a second row pressure and a third row pressure respectively; and the second row pressure is larger than the third row pressure, and the third row pressure is larger than the first row pressure.

11. An automatic teller machine, comprising an automatic banknote depositing device, wherein the deflection correcting device according to claim 10 is provided in the automatic banknote depositing device.

12. An automatic teller machine, comprising an automatic banknote depositing device, wherein the deflection correcting device according to claim 1 is provided in the automatic banknote depositing device.

13. An automatic teller machine, comprising an automatic banknote depositing device, wherein the deflection correcting device according to claim 1 is provided in the automatic banknote depositing device.

* * * * *